US009722382B2

(12) United States Patent
Goodman

(10) Patent No.: US 9,722,382 B2
(45) Date of Patent: Aug. 1, 2017

(54) PIN EXTRACTOR

(71) Applicant: Raytheon Company, Waltham, MA (US)

(72) Inventor: Chase David Goodman, Waltham, MA (US)

(73) Assignee: Raytheon Company, Waltham, MA (US)

( * ) Notice: Subject to any disclaimer, the term of this patent is extended or adjusted under 35 U.S.C. 154(b) by 533 days.

(21) Appl. No.: 13/919,831

(22) Filed: Jun. 17, 2013

(65) Prior Publication Data

US 2014/0366355 A1 Dec. 18, 2014

(51) Int. Cl.

| | |
|---|---|
| ***H01R 43/22*** | (2006.01) |
| ***H01R 13/426*** | (2006.01) |
| ***B25B 27/02*** | (2006.01) |

(52) U.S. Cl.

CPC ..... *H01R 43/22* (2013.01); *B25B 27/02* (2013.01); *H01R 13/426* (2013.01); *Y10T 29/49822* (2015.01); *Y10T 29/53283* (2015.01)

(58) Field of Classification Search

CPC ..... H01R 43/22; Y10T 29/49822; Y10T 29/53283

See application file for complete search history.

(56) References Cited

U.S. PATENT DOCUMENTS

| | | | | |
|---|---|---|---|---|
| 3,698,058 | A * | 10/1972 | Reimer | H01R 43/027 29/747 |
| 3,769,680 | A * | 11/1973 | Anhalt | H01R 43/205 29/764 |
| 3,802,049 | A | 4/1974 | Hennessy | |
| 4,285,123 | A | 8/1981 | Chisholm | |
| 4,425,704 | A | 1/1984 | Cline | |
| 4,494,305 | A * | 1/1985 | Safai | H01R 43/22 29/758 |
| 5,575,691 | A | 11/1996 | Matthews | |
| 6,067,705 | A | 5/2000 | Boyde et al. | |
| 2003/0229985 | A1 | 12/2003 | Kappel et al. | |

FOREIGN PATENT DOCUMENTS

| | | | |
|---|---|---|---|
| CN | 201528119 | U | 7/2010 |

OTHER PUBLICATIONS

PCT Application PCT/US2014/033836; filed Apr. 11, 2014; Raytheon Company; international search report mailed Jul. 7, 2014.

* cited by examiner

*Primary Examiner* — Livius R Cazan

(57) ABSTRACT

A pin extractor is disclosed. The pin extractor can comprise a press to act against a clip securing a pin to be extracted. The press can have a clip interface feature at an end of the press configured to compress the clip radially inward upon application of a force against the clip. The pin extractor can also comprise a puller having a claw to engage the pin. The puller can be movable relative to the press to extract the pin as the press compresses the clip radially inward.

16 Claims, 8 Drawing Sheets

PIN EXTRACTOR

GOVERNMENT LICENSE RIGHTS

This invention was made with government support under government contract FA8675-07-C-0055 awarded by the Department of Defense. The government has certain rights in the invention.

BACKGROUND

Electronic components often utilize one or more pins to facilitate an electrical connection. Some pins are designed to accommodate repeated connections and disconnections as electronic components are interchanged, such as in an electronic test station with a circuit card assembly. Due to repeated use, pin contacts can wear out necessitating replacement or repair of some pins. Accordingly, removal tools and compatible pins have been designed to provide for easy removal of the pins, which facilitates repair of the pin contacts and reuse of the pins without damaging the pins upon removal. However, some pins have been designed to be destructively removed, in that the pins include no features that facilitate removal without deformation of the pins. Such pins are typically removed with pliers or other gripping or clamping tools that can pull and twist the pins for removal. The old pins are then replaced with new pins since the old pins have been deformed beyond repair upon removal.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
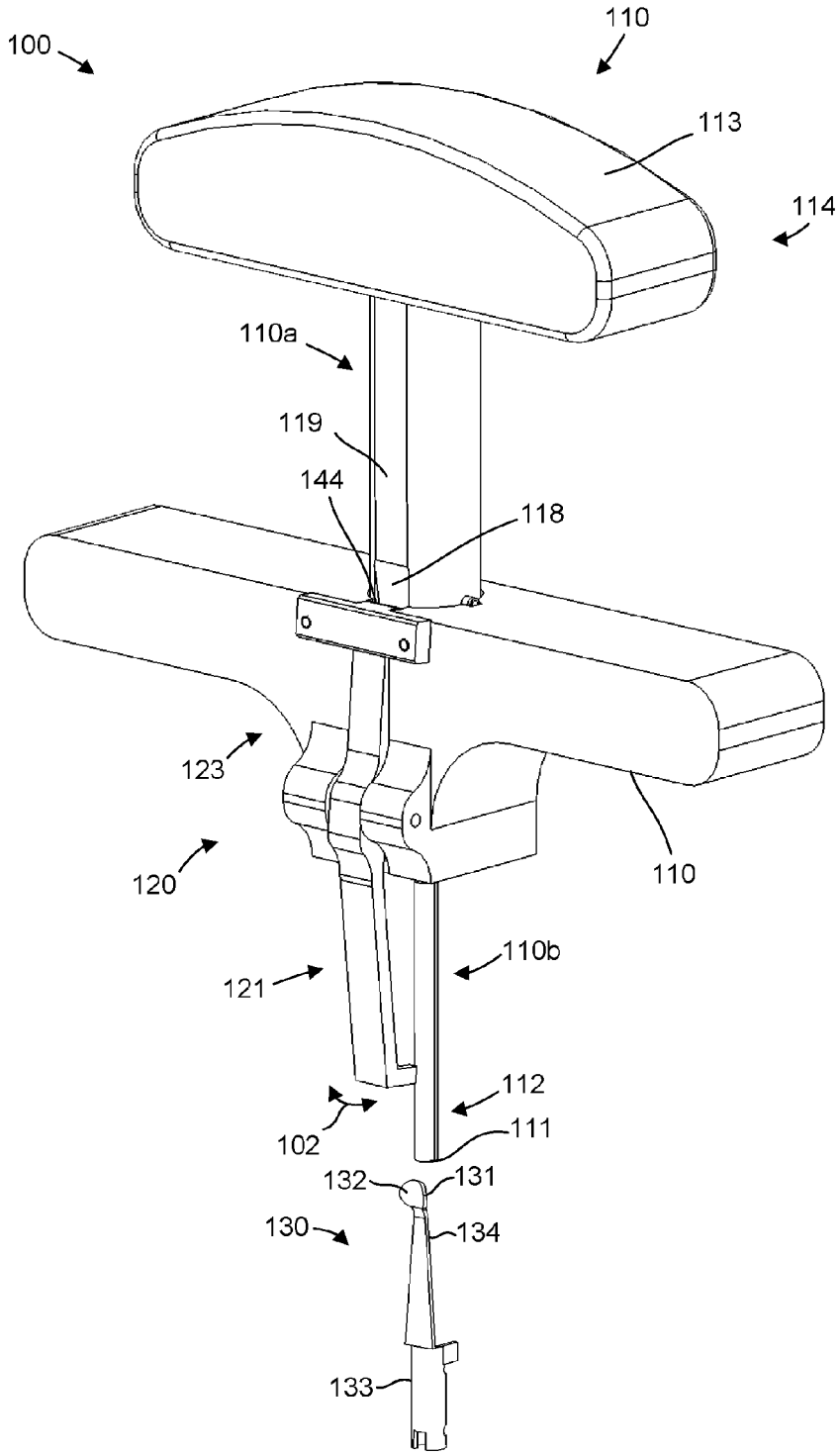
FIG. 1A is an example illustration of a pin extractor in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although replacement pins for those that are destructively removed are often available, sometimes manufacturers cease production of particular models of such pins and no suitable replacements are available. In this case, it can be desirable to repair or refurbish old used pins for reuse. However, due to the destructive nature of the typical removal tools and processes, repair and reuse of these pins is not possible. Thus, pins that are typically destroyed when extracted can be salvaged and reused by an extraction tool that can remove these pins without damage.

Accordingly, a pin extractor is disclosed that facilitates removal of pins without damage in a manner that would permit repair and/or reuse of the pins. Prior related devices typically destructively remove such pins to the point that would prevent their repair and reuse. In one aspect, the pin extractor is operable to remove a "paddle" style pin, such as may be used in an electronic test station with a circuit card assembly. The pin extractor can include a press to act against a clip securing a pin to be extracted. The press can have a clip interface feature at an end of the press configured to compress the clip radially inward upon application of a force against the clip. The pin extractor can also include a puller that can have a claw to engage the pin. The puller can be movable relative to the press to extract the pin as the press compresses the clip radially inward.

In one aspect, a pin extraction system is disclosed. The system can include a pin to be extracted, a clip securing the pin, and a pin extractor. The pin extractor can include a press to act against the clip. The press can have a clip interface feature at an end of the press configured to compress the clip radially inward upon application of a force against the clip. The pin extractor can also include a puller that can have a claw to engage the pin. The puller can be movable relative to the press to extract the pin as the press compresses the clip radially inward.

Figure 1B:
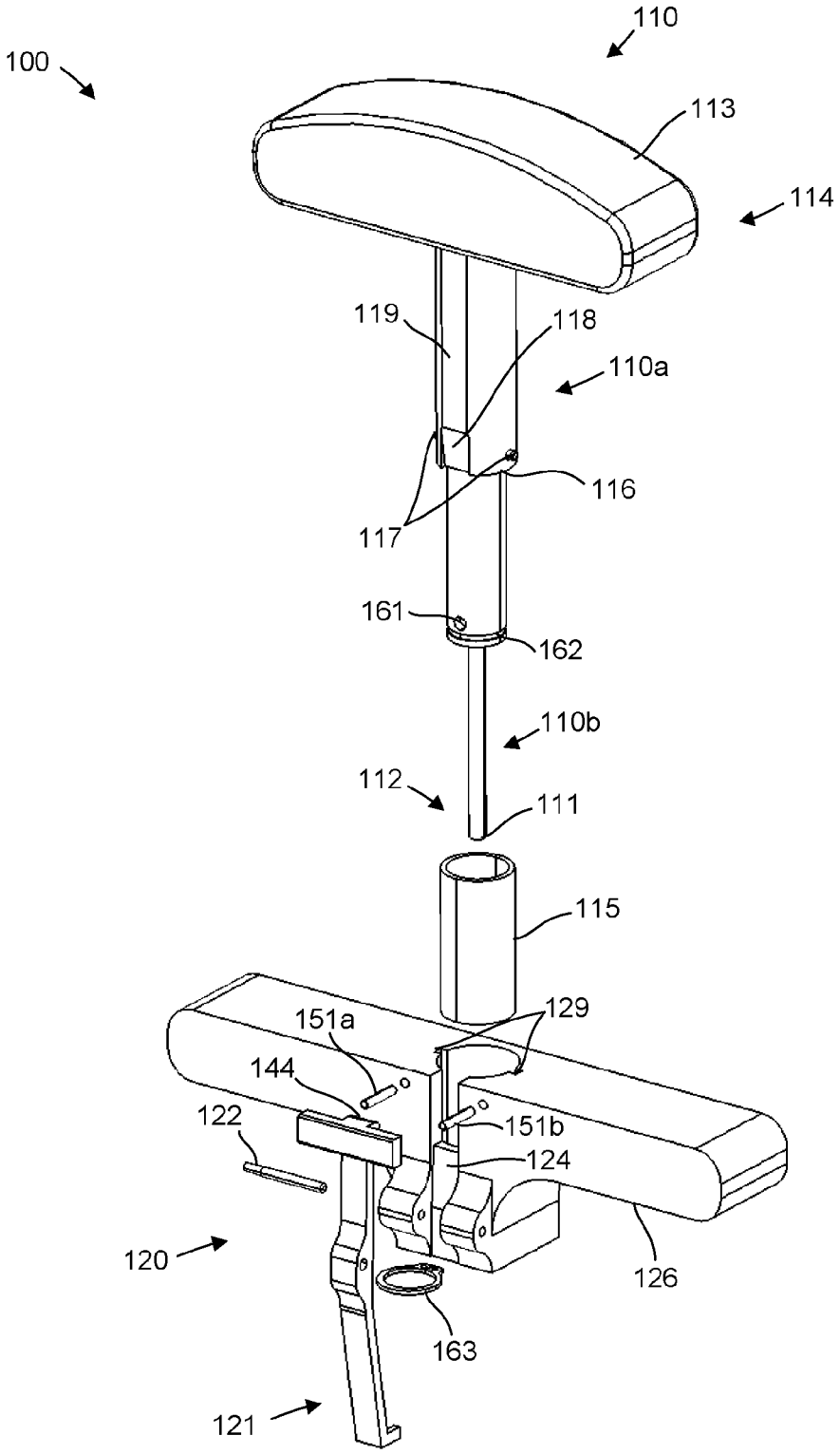
FIG. 1B is an exploded view of the pin extractor of FIG. 1A.

One embodiment of a pin extractor 100 is illustrated in FIGS. 1A and 1B. In general, the pin extractor 100 can comprise a press 110 and a puller 120. The press can be configured to act against a clip (not shown) securing a pin 130 to be extracted. In one aspect, the pin 130 can be a "paddle" style pin, which can be used in a test station among other things. The pin 130 does not typically include any features that are specifically designed to facilitate extraction of the pin 130 without damage. Thus, the pin 130 is typically not reused due to damage incurred upon extraction. The pin 130 can have a head 131 with a contact portion 132 adapted to mate with a curved or rounded contact (not shown). The pin 130 can also have a base 133 configured to interface with the clip and a neck 134 extending from the base 133. The head 131 can be coupled to the neck 134.

The puller 120 can have a claw 121 to engage the pin 130. In one aspect, the claw 121 can be pivotally supported, such as with a pivot pin 122 supported by a base portion 123 of the puller 120, to facilitate engagement with the pin 130. For example, the pin 130 can be surrounded by other pins and/or a side wall to facilitate coupling the pin 130 with a contact. A lack of space about the pin 130 can limit the ability to maneuver the pin extractor 100 such that the claw 121 can engage the pin 130. Thus, the ability to pivot the claw 121 bi-directionally in direction 102 can provide clearance for the claw 121 about the pin 130 and facilitate engagement with the pin 130 without requiring rotation or other significant maneuvering of the pin extractor 100.

Figure 3A:
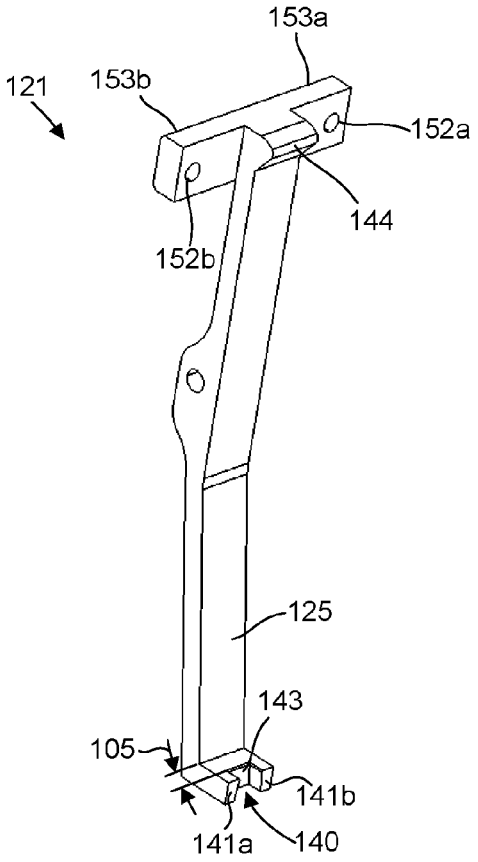
FIG. 3A illustrates a claw of the puller of the pin extractor of FIG. 1A.

In another aspect, the claw 121 can be biased, such as by a spring 151*a*, 151*b*, toward an engaged position with the pin 130. For example, once the claw 121 has been pivoted to clear the head 131 of the pin 130, the claw 121 can be allowed to move under a biasing force to engage the pin 130. The spring 151*a*, 151*b* can be configured to interface with and act against the base portion 123 and the claw 121. For example, the claw can be configured to interface with the spring 151*a*, 151*b*, such as with an opening or recess 152*a*, 152*b*, respectively, as shown in FIG. 3A. The opening 152*a*, 152*b* can be suitably located by an extension 153*a*, 153*b*, respectively, which in this case is configured to interface with the spring 151*a*, 151*b* on lateral sides of the claw 121.

Figure 2:
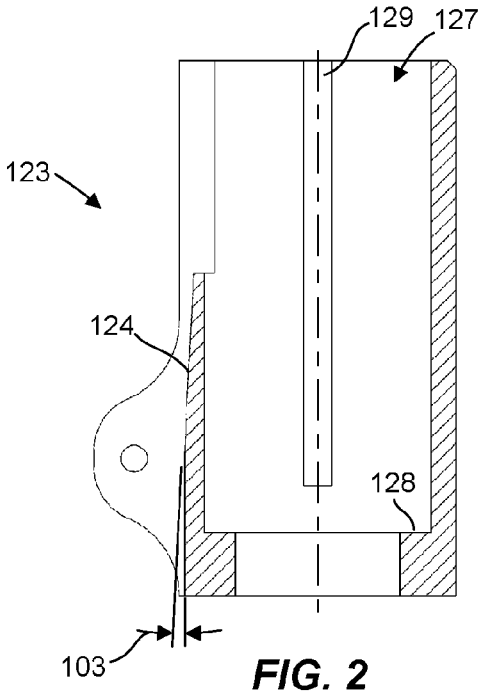
FIG. 2 is cross-section view of a portion of a puller of the pin extractor of FIG. 1A.

As shown in FIG. 2, the base portion 123 of the puller 120 can include a feature 124 configured to facilitate a desired range of rotational motion for the claw 121. For example, the feature 124 can be recessed or oriented at an angle 103 to facilitate rotation of the claw 121 about the pivot pin 122 sufficient to provide clearance for the claw 121 to engage the pin 130. In one aspect, the feature 124 can be configured to provide a mechanical stop for the claw 121.

Figure 3B:
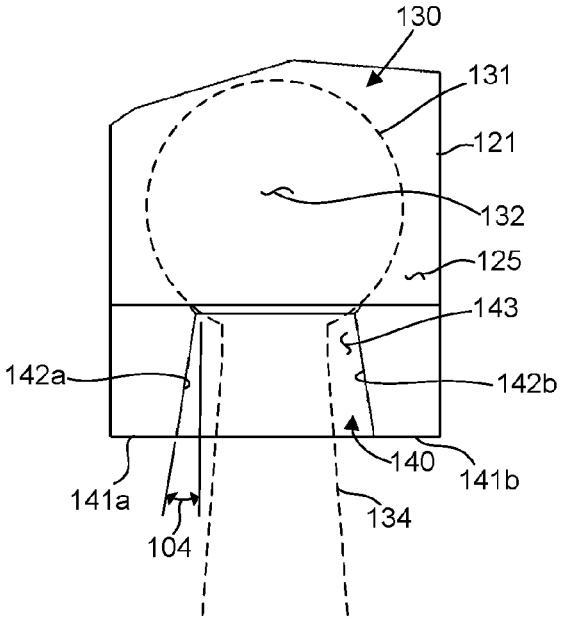
FIG. 3B is a detail view of an end of the claw of FIG. 3A.

FIGS. 3A and 3B illustrate aspects of the claw 121 that can facilitate engaging the pin 130. For example, the claw 121 can comprise an opening 140 defined by protrusions 141*a*, 141*b*. The opening 140 can be configured to receive the neck 134 of the pin 130 and the protrusions 141*a*, 141*b* can be configured to engage the head 131 of the pin 130. In one aspect, the protrusions 141*a*, 141*b* can be configured to include surfaces 142*a*, 142*b*, respectively disposed at an angle 104. The angled surfaces 142*a*, 142*b* can be configured to facilitate contact between the protrusions 141*a*, 141*b* with the head 131 without interference with the neck 134 that would prevent such contact with the head 131. In addition, the opening 140 can be defined by a back wall 143 offset 105 from an arm 125 engaging the head 131 of the pin 130. This manner of engaging the pin 130 can preserve the contact portion 132 untouched by a potentially damaging surface. Thus, the geometry of the pin 130 can remain essentially intact upon removal, which facilitates reuse of the pin following refurbishment of the contact portion 132, as needed.

With further reference to FIGS. 1A-2, the pin extractor 100 can be configured such that the puller 120 can be movable relative to the press 110 to extract the pin 130 as the press 110 acts against the clip, as described in more detail hereinafter. For example, the press 110 can include a handle 113 at an end 114 opposite the clip interface feature 111 to interface with a palm of a user to apply the force against the clip. Furthermore, the puller 120 can have a grasping feature 126 to interface with a finger of the user to move the puller 120 relative to the press 110. In one aspect, the grasping feature 126 and the handle 113 can be biased away from one another, such as by a spring 115, to move and/or return the puller 120 to a position relative to the press 110 in preparation to extract the pin 130, thus reducing the time between pin extractions. The spring 115 can reside in an opening 127 of the puller 120 to seat against a land 128 in the puller 120 and can be disposed about the press 110 to seat against a shoulder 116 of the press 110. The spring 115 can comprise any suitable type of spring, such as a coil spring, an elastomeric spring, etc. The press 110 can include a groove 162 configured to receive a clip 163 to secure the puller 120 to the press 110 and prevent unwanted separation of the puller 120 and press 110, such as may be caused by a force of the spring 115.

In one aspect, the press 110 and the puller 120 can be constrained to sliding relative movement by a pin 117 and channel 129 configuration. This can maintain the handle 113 and the grasping feature 126 in a consistent alignment with one another to facilitate ease of use of the pin extractor 100. Although the pin 117 is shown associated with the press 110 and the channel 129 is shown associated with the puller 120, it should be recognized that a pin can be associated with the puller 120 and a channel can be associated with the press 110.

Figure 4A:
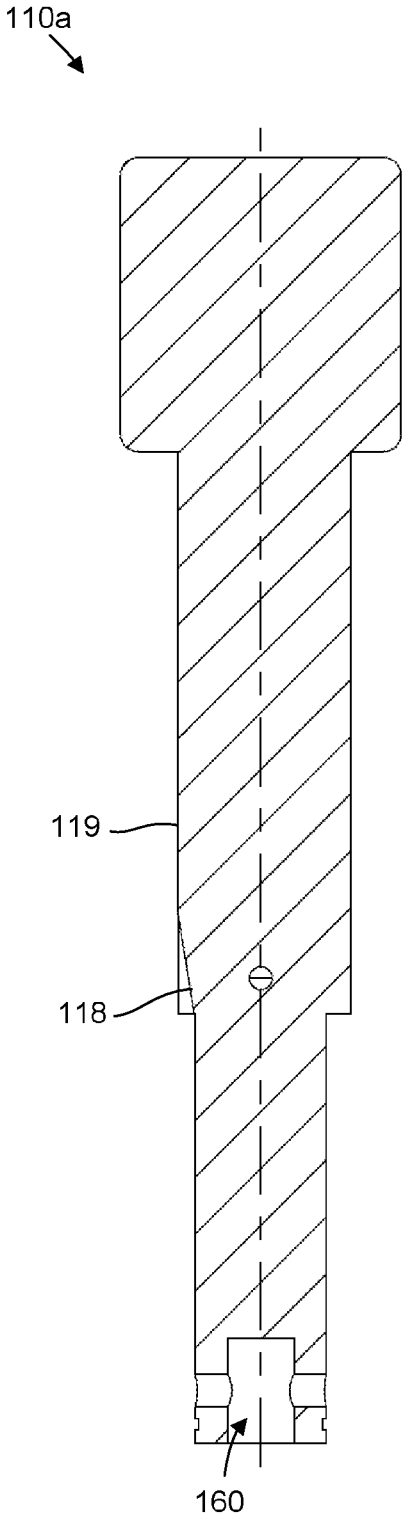
FIG. 4A is a cross-section view of a portion of a press of the pin extractor of FIG. 1A.

With reference to FIG. 4A and further reference to FIGS. 1A and 1B, the press 110 can have an upper portion 110*a* and a lower portion 110*b*. The upper portion 110*a* can include the handle 113 and the lower portion 110*b* can include the clip interface feature 111. In one aspect, the upper portion 110*a* and the lower portion 110*b* can be separate components configured to couple to one another. For example, the upper portion 110*a* can include a socket 160 to receive the lower portion 110*b*. The upper portion 110*a* and the lower portion 110*b* can be secured to one another with a pin 161. This can be beneficial to provide for interchangeability of clip interface features, such that a lower portion can be removed and replaced with another lower portion if the clip interface feature has been damaged or if a clip interface feature of a different size is needed to accommodate a different size clip and/or pin. It should be recognized that the upper portion 110*a* and the lower portion 110*b* can be of a single unitary construction.

With further reference to FIGS. 1A, 1B, 3A, and 4A, in one aspect, the claw 121 and the press 110 can be configured to provide for pivotal rotation of the claw 121 as well as relative movement between the puller 120 and the press 110. In one aspect, an end 144 of the claw 121 can be configured to protrude in order to contact the press 110, such as at a ramp 118, and provide a mechanical stop for the pivotal rotation of the claw 121. In another aspect, the ramp 118 can be configured to interface with the end 144 of the claw 121 to accommodate relative movement between the puller 120 and the press 110 by facilitating sliding of the end 144 of the claw 121 along the ramp 118. In one aspect, the end 144 of the claw 121 can be configured to interface with the ramp 118 to ensure pivoting of the claw 121 toward an engaged position with the pin 130 as the puller 120 moves relative to the press 110. For example, the ramp 118 can force the claw 121 to pivot as the end 144 of the claw 121 slides along the ramp 118 and can be configured to position the claw 121 for engagement with the pin 130. The surface 119 of the press 110 can maintain the claw 121 in the engaged position as the puller 120 moves relative to the press 110 and the end 144 of the claw 121 slides along the surface 119 after transitioning from the ramp 118. In one aspect, the ramp 118 and surface 119 can work in conjunction with the spring 151*a*, 151*b* to move the claw 121 toward, and/or maintain the claw 121 in, the engaged position with the pin 130.

Figure 4B:
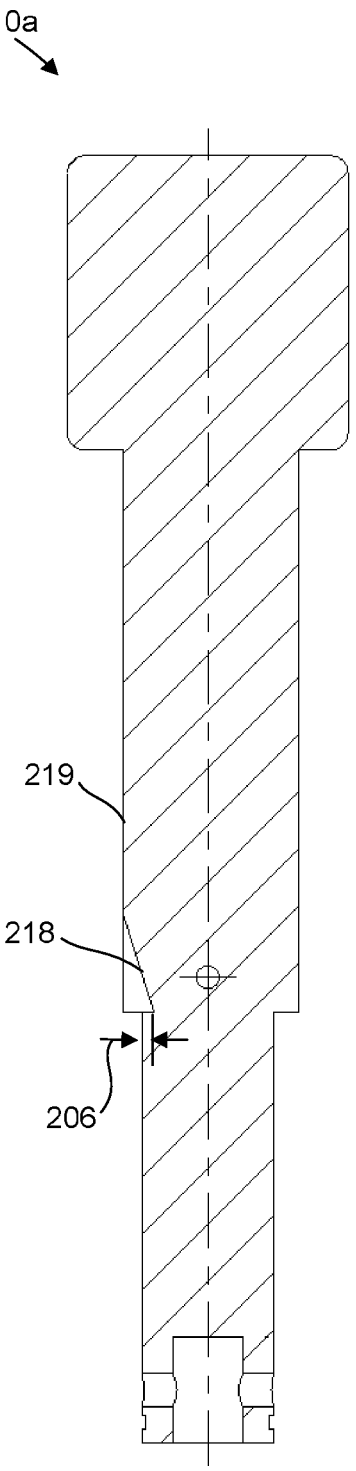
FIG. 4B is a cross-section view of a portion of a press of a pin extractor in accordance with another embodiment of the present invention.

FIG. 4B illustrates an upper portion 210*a* of a press in accordance with another example of the present disclosure. In this case, an end of a ramp 218 is recessed or offset 206 to facilitate further pivotal rotation of a claw compared to the example illustrated in FIG. 4A. This can be useful to accommodate a longer protruding end of a claw, such as may be necessary to ensure contact between the protruding end of the claw and the surface 219 to maintain the claw in positive engagement with the pin during extraction.

Figure 5:
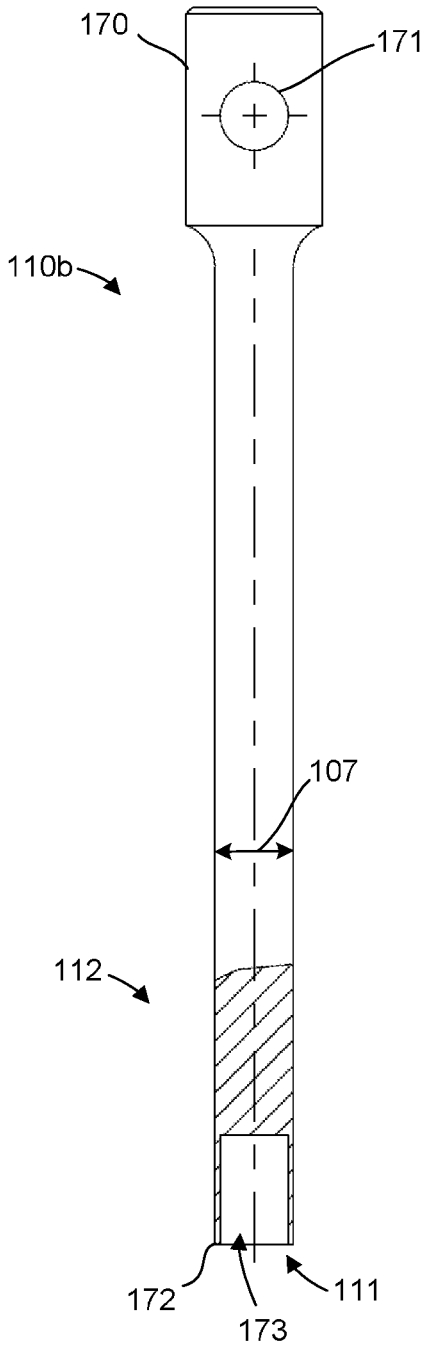
FIG. 5 is a detail view of a pin interface feature of the press of the pin extractor of FIG. 1A.
Figure 6:
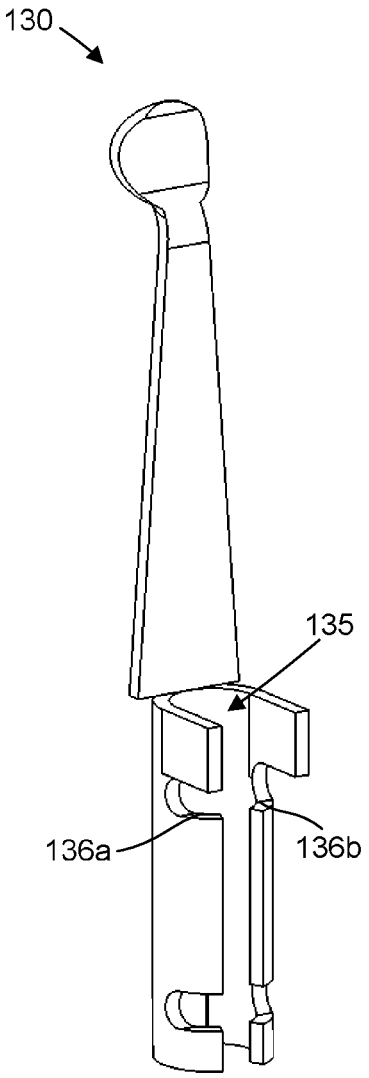
FIG. 6 illustrates a pin that can be extracted by the pin extractor of FIG. 1A.

With reference to FIGS. 5 and 6, and further reference to FIGS. 1A, 1B, and 4A, the lower portion 110*b* of the press 110 and the pin 130 are discussed in more detail. For example, an end 170 of the lower portion 110*b* can be configured to be received within the socket 160 of the upper portion 110*a* and can include a hole 171 to receive the pin 161 to secure the upper and lower portions 110*a*, 110*b* to one another.

In addition, the end 112 of the lower portion 110*b* of the press 110 can be configured to facilitate passage of the pin 130 about the press 110 upon extraction of the pin 130. For example, the pin 130 can have an opening 135 configured to receive a clip operable to secure the pin 130 by contacting a land 136*a*, 136*b* of the pin 130. During extraction of the pin 130, the clip can be disengaged from the lands 136*a*, 136*b*, allowing the pin 130 to slide over the end 112 of the press 110. Accordingly, an outer diameter 107 of the end 112 of the press 110 can be configured fit within the opening 135 of the pin 130. In one aspect, the end 112 of the press 110 can comprise a cylindrical configuration, although any suitable configuration or shape can be used. In another aspect, the clip interface feature 111 can include a contact surface 172, such as a rim, which at least partially defines an opening 173.

Figures 7A, 7B, 7C, 7D:
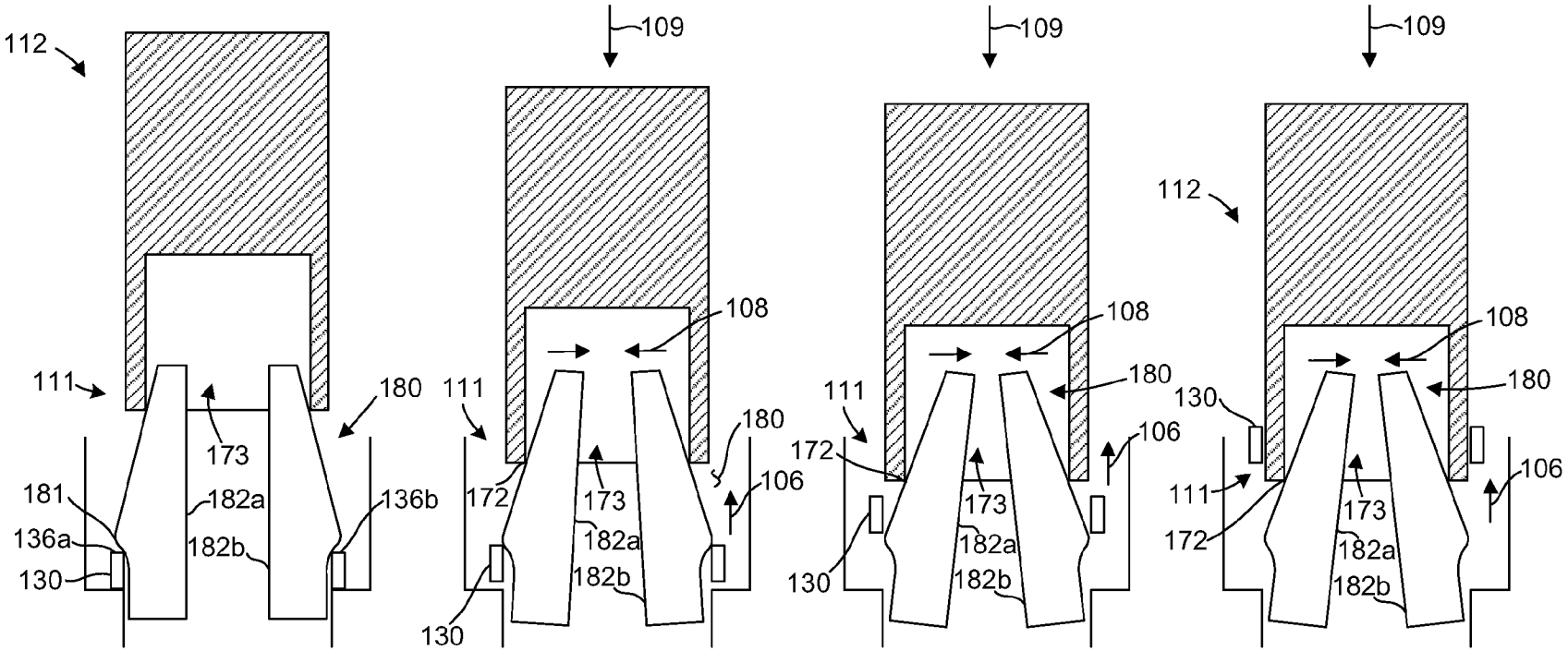
FIGS. 7A-7D are schematic illustrations of a pin extractor in operation detailing a clip interface feature of a press acting against a clip to extract a pin, in accordance with an embodiment of the present invention.

With continued reference to FIGS. 1A, 1B, 5, and 6, certain aspects of the end 112 of the press 110 are shown in FIGS. 7A-7D, which are schematic illustrations of the pin extractor 100 in operation and detail the clip interface feature 111 acting against a clip 180 to extract the pin 130. For example, as shown in FIG. 7A, the clip 180 can comprise a pin securing portion 181 biased outward to secure the pin 130, such as by contacting lands 136*a*, 136*b*. The pin securing portion 181 can comprise a plurality of independently movable segments 182*a*, 182*b*. For example, the clip 180 can comprise a four-prong collet interface to secure the pin 130.

As shown in FIGS. 7B-7D, the clip interface feature 111 can be configured to compress the clip 180, such as the movable segments 182*a*, 182*b* of the pin securing portion 181, radially inward 108 upon application of a force 109 against the clip 180. In one aspect, the clip interface feature 111, such as the contact surface 172 or rim, can be configured to contact and slide over the clip 180 to compress the clip 180 radially inward 108 upon the application of the force 109 against the clip 180. The contact surface 172 or rim can be of any suitable configuration for contacting and sliding along or over the clip 180, such as an angled, tapered, or rounded surface or edge. In another aspect, the opening 173 can be configured to receive at least a portion of the clip 180 as the clip interface feature 111, such as the contact surface 172 or rim, slides over the clip 180.

FIGS. 7B-7D further illustrate that as the clip 180 is radially compressed, the pin 130 can be moved in direction 106 to extract or remove the pin 130 from the clip 180. In one aspect, therefore, the pin extractor 100 can cause the pin 130 to move in direction 106 at the same time that the force 109 is applied to the clip 180 causing the clip 180 to move radially inward 108. This simultaneous action or motion facilitated by the pin extractor 100 can be instrumental in extracting or removing the pin 130 from the clip 180. FIG. 7D shows the clip 180 remaining radially compressed until the pin 130 is removed from the clip 180 and disposed about the end 112 of the press 110 in order to ensure that the clip 180 does not interfere with the pin 130 when the pin extractor 100 is removed from the clip 180. Thus, the pin extractor 100 can facilitate removal of the pin 130 from engagement with the clip 180 substantially undamaged, which can facilitate reuse of the pin 130.

Figure 8D:
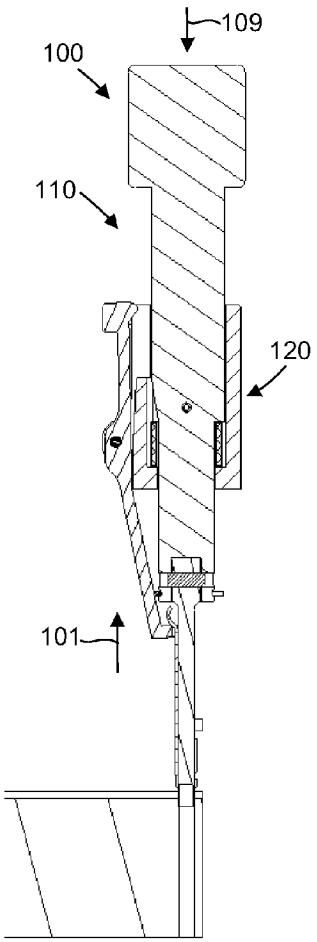
FIGS. 8A-8D are schematic illustrations of a pin extractor in operation showing a claw of a puller engaging a pin and moving relative to a press to extract the pin, in accordance with an embodiment of the present invention.
Figure 8C:
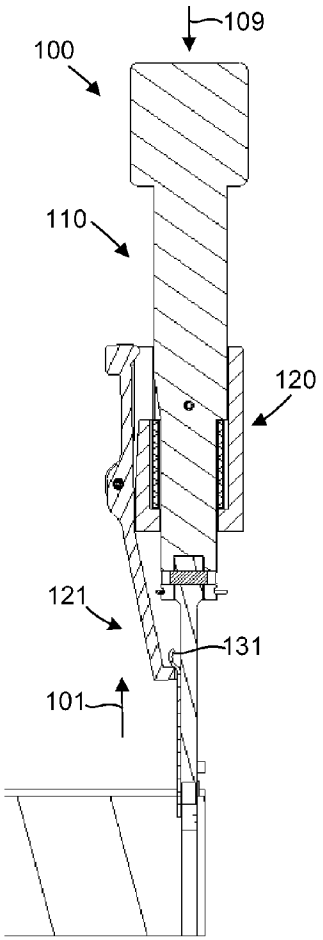
Figure 8B:
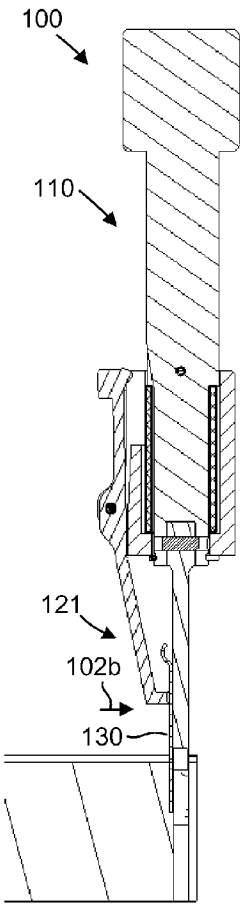
Figure 8A:
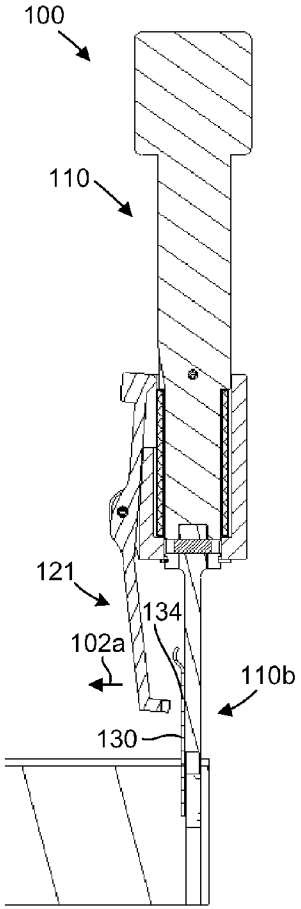

With further reference to FIGS. 1A-7D, primary reference is now made to FIGS. 8A-8D, which are schematic illustrations of the pin extractor 100 in operation showing the claw 121 of the puller 120 engaging the pin 130 and moving relative to the press 110 to extract the pin 130 as the press 110 compresses the clip 180, as shown in FIGS. 7A-7D. The clip 180 is omitted from FIGS. 8A-8D for clarity. In particular, FIG. 8A shows the claw 121 pivoted outward in direction 102*a* to facilitate positioning the lower portion 110*b* of the press 110 to interact with the clip 180, preparatory to engaging the pin 130 with the claw 121. The lower portion 110*b* of the press 110 is proximate the neck 134 of the pin 130 and can support the neck 134 upon engagement with the claw 121. FIG. 8B shows the claw 121 pivotally rotated in direction 102*b* to engage the pin 130, such as the neck 134 of the pin 130. The puller 120 can be moved in a direction 101 relative to the press 110 to cause the claw 121 to engage the head 131 of the pin 130, as shown in FIG. 8C. Simultaneously, the force 109 can be applied to the press 110, causing the press 110 to act against the clip 180 and compress the clip 180 to facilitate release of the pin 130 from the clip 180, as shown in FIGS. 7B-7D. The pin 130 is moved in a direction parallel to the direction 101 and to the force 109. Thus, the simultaneous acts of pushing on the press 110 and pulling on the puller 120 can extract the pin 130. As shown in FIG. 8D, the puller 120 can be moved further in direction 101 relative to the press 110 to extract or remove the pin 130 from the clip 180 as the press 110 compresses the clip 180. The pin extractor 100 can therefore facilitate the simultaneous and combined operations of depressing the clip 180 and pulling the pin 130 away from the clip 180. Since the pulling contact on the pin 130 is at the base of the head 131, the pin base 133, the neck 134, and the contact portion 132 can remain substantially and functionally undamaged by the extraction process. Following extraction, the puller 120 can be moved back to its original position, such as by the spring-loaded return action of the spring 115, the claw 121 can be pivoted to release the pin 130, such as by acting against the spring 151*a*, 151*b*, and the pin 130 can be removed from the end 112 of the press 110.

The result is that the pin 130 can emerge functionally undamaged from the extraction process and therefore can be reconditioned and reused.

Figure 9D:
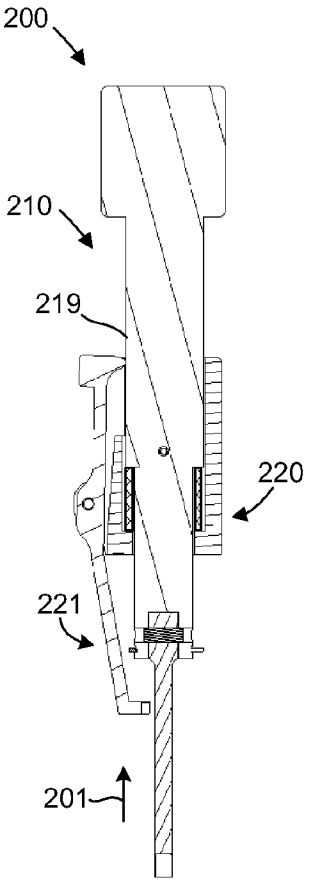
FIGS. 9A-9D are schematic illustrations of a pin extractor in operation, in accordance with another embodiment of the present invention.
Figure 9C:
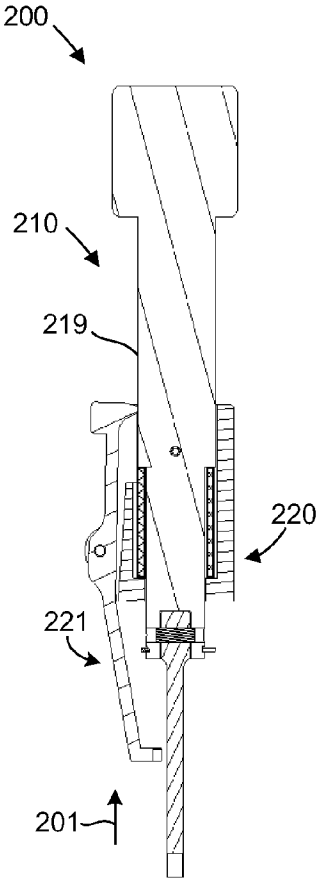
Figure 9B:
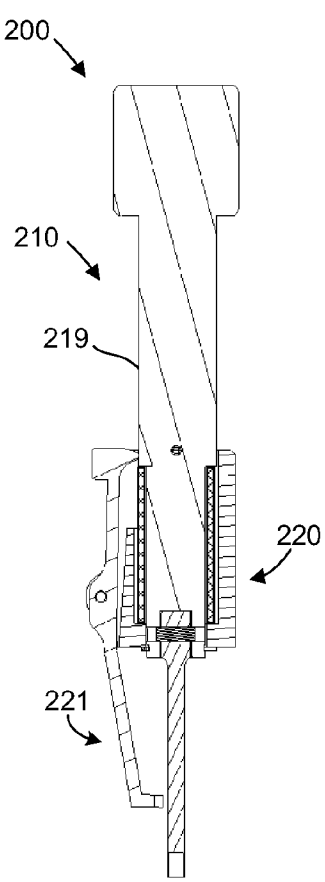
Figure 9A:
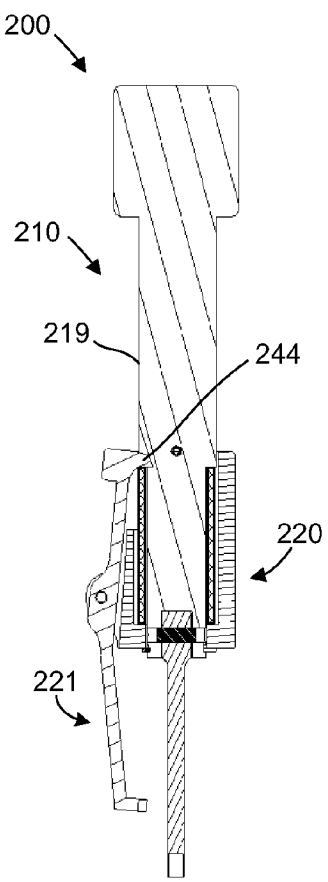

FIGS. 9A-9D are schematic illustrations of a pin extractor 200 in operation, in accordance with another embodiment of the present disclosure. In general, the operation of the pin extractor 200 to extract a pin is similar to that shown and described relative to FIGS. 8A-8D. In this case, a press 210 of the pin extractor 200 includes the upper portion 210*a* of FIG. 4B, which is configured to accommodate a long protruding end 244 of a claw 221 configured to ensure contact between the protruding end 244 of the claw 221 and the surface 219 of the press 210 to maintain the claw 221 in positive engagement with a pin during extraction. Thus, as shown in FIGS. 9C and 9D, the protruding end 244 of the claw 221 can slide along the surface 219 as the puller 220 to maintain the claw 221 in engagement with a pin as the puller 220 moves relative to the press 210 to extract the pin.

In accordance with one embodiment of the present invention, a method for facilitating extraction of a pin is disclosed. The method can comprise providing a pin extractor including a press to act against a clip securing a pin to be extracted, and a puller having a claw to engage the pin. The method can further comprise facilitating compression of the clip radially inward upon application of a force against the clip. Additionally, the method can comprise facilitating movement of the puller relative to the press to extract the pin as the press compresses the clip radially inward. It is noted that no specific order is required in this method, though generally in one embodiment, these method steps can be carried out sequentially.

In one aspect, the press can comprise a clip interface feature at the end of the press configured to compress the clip radially inward upon application of the force against the clip. In another aspect, the puller can be slidable relative to the press to extract the pin.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A pin extractor, comprising:

a press to act against a clip securing a pin to be extracted, the press having a lower portion with a clip interface feature at an end of the press configured to compress the clip radially inward upon application of a force against the clip, and an upper portion having a ramp;

a puller slidably coupled to the press; and a claw, pivotally coupled to the puller, with a first end to engage the pin, and a second end opposite the first end that interfaces with the ramp, wherein the puller and the claw are simultaneously slidably movable relative to the press to extract the pin as the press compresses the clip radially inward, and the ramp interface with the second end of the claw forces the claw to pivot toward an engaged position with the pin.

2. The pin extractor of claim 1, wherein the clip interface feature is configured to contact and slide over the clip to compress the clip radially inward upon the application of the force against the clip.

3. The pin extractor of claim 1, further comprising an opening defined at least in part by a rim of the clip interface feature to receive at least a portion of the clip as the rim slides over the clip.

4. The pin extractor of claim 1, wherein the end of the press is configured to facilitate passage of the pin about the press upon extraction of the pin.

5. The pin extractor of claim 4, wherein the end of the press comprises a cylindrical configuration.

6. The pin extractor of claim 1, wherein the claw is biased toward an engaged position.

7. The pin extractor of claim 1, wherein an upper portion of the press further comprises a claw interface surface proximate the ramp that interfaces with the second end of the claw to maintain the claw in the engaged position as the puller moves relative to the press.

8. The pin extractor of claim 1, wherein the claw comprises an opening defined by first and second protrusions, the opening being configured to receive a neck of the pin and the first and second protrusions being configured to engage a head of the pin.

9. The pin extractor of claim 1, wherein the press comprises a handle at an end opposite the clip interface feature to interface with a palm of a user to apply the force against the clip.

10. The pin extractor of claim 9, wherein the puller comprises a grasping feature to interface with a finger of a user to move the puller relative to the press.

11. The pin extractor of claim 10, wherein the grasping feature and the handle are biased away from one another.

12. The pin extractor of claim 1, wherein the press and the puller are constrained to sliding relative movement by a pin and channel configuration.

13. A pin extraction system, comprising:

a pin to be extracted;

a clip securing the pin; and a pin extractor, including a press to act against the clip, the press having a lower portion with a clip interface feature at an end of the press configured to compress the clip radially inward upon application of a force against the clip, and an upper portion having a ramp, and a puller slidably coupled to the press; and a claw, pivotally coupled to the puller, with a first end to engage the pin, and a second end opposite the first end that interfaces with the ramp, wherein the puller and the claw are simultaneously slidably movable relative to the press to extract the pin as the press compresses the clip radially inward, and the ramp interface with the second end of the claw forces the claw to pivot toward an engaged position with the pin.

14. The system of claim 13, wherein the clip comprises a pin securing portion biased outward to secure the pin.

15. The system of claim 14, wherein the pin securing portion comprises a plurality of independently movable segments.

16. The system of claim 13, wherein the pin comprises a base configured to interface with the clip, a neck extending from the base, and a head coupled to the neck.

* * * * *